United States Patent [19]

Nikkel et al.

[11] Patent Number: 4,495,890

[45] Date of Patent: Jan. 29, 1985

[54] MOBILE COATER

[75] Inventors: Willem A. Nikkel, Covington; John B. Young, Richmond, both of Va.

[73] Assignee: Westvaco Corporation, New York, N.Y.

[21] Appl. No.: 513,361

[22] Filed: Jul. 13, 1983

[51] Int. Cl.[3] ..... B05C 1/08; B05C 11/02

[52] U.S. Cl. ..... 118/674; 118/680; 118/118; 118/246; 118/262

[58] Field of Search ..... 118/246, 262, 118, 672, 118/674, 680, 235

[56] References Cited

U.S. PATENT DOCUMENTS

| | | | |
|---|---|---|---|
| 2,329,034 | 9/1943 | Buck et al. | 118/262 X |
| 3,186,861 | 6/1965 | Smith et al. | 118/118 X |
| 4,061,109 | 12/1977 | Allen | 118/118 |

*Primary Examiner*—John P. McIntosh

*Attorney, Agent, or Firm*—W. A. Marcontell; R. L. Schmalz

[57] ABSTRACT

A portable coating apparatus is described for use with a paper converting machine such as a corrugated paperboard double-backer. Rotational power to drive gravure, transfer and smoothing rolls is extracted from the converting machine supply web by an S-wrap through the loaded nip between a pair of drive rolls. A low-powered auxiliary drive motor is automatically engaged to keep the gravure and transfer rolls conditioned with coating during brief intervals of web feed cessation. The entire unit is constructed on a space frame that is supported by caster wheels to facilitate movement to and from an appropriate converting machine position which may be between the reeled web supply unwind stand and a web preheating drum station leading into a double-backing machine.

6 Claims, 4 Drawing Figures

MOBILE COATER

BACKGROUND OF THE INVENTION

1. Field of the Invention

The present invention relates to apparatus for continuously coating the surface of a traveling web with a liquid preparation. More particularly, the present invention relates to an apparatus for coating an indefinite length liner web while in transit through a corrugated paperboard fabricating machine.

2. Description of the Prior Art

Corrugated paperboard is normally fabricated from reeled paper web supplies of indefinite length by a series of forming and laminating steps. The corrugated medium is formed first in the meshing nip of two fluted surface cylinders. Prior to release from the second cylinder flutes, tips of the medium web formed thereto are adhesively secured to the face of a first paper liner web to secure the periodic distance between adjacent flute tips. Assembly completion of a double-faced board product comprises the adhesive lamination of a second liner web to the exposed side flute tips of a previously assembled single-face product.

Countless permutations of the above process are possible to achieve a desired performance specification or esthetic appearance.

For normally stocked box applications, the liner web faces of the laminated assembly are fabricated of 0.009 to 0.030 inch caliper unbleached kraft process paper. Particular customers, however, have the outer liner face of their boxboard containers coated for improvement of the print surface quality, it being their objective to provide advertising or content information directly on the container surface. Such coating and printing must be applied prior to the corrugated assembly due to the incompatibility of the resilient corrugated board section with rotary printing machines. Consequently, box manufacture order lots of coated or printed faces boxes are usually handled individually and require stoppage of the corrugating machinery for material changes and machinery adjustment. This machine downtime represents unproductive capital and thereby dramatically increases the production cost of each coated surface box order.

Within the scope of specially ordered boxboard products are those which are merely coated but not printed. In this case, the liner coating may be applied at the "double-facer" station to normal liner web stocks without other changes in the corrugating machine operation. Unfortunately, prior art machine applied face coatings of boxboard liner web stock have been crude and tend to produce a product of inferior quality. Usually, these coating defects are directly attributable to poor design practices and the fact that prior coating devices use stationary wiper blades for spread and distribution control.

It is therefore, an object of the present invention to provide a web coating apparatus that is capable of first quality productivity and is removable from the double-facer machine proximity when not in use.

Another object of the present invention is to provide a portable gravure roll coating apparatus.

Another object of the present invention is to provide a gravure roll coating apparatus having a counter-rotating wiper roll to even the coating film thickness over the gravure roll surface.

Another object of the present invention is to provide a portable, gravure roll, web coating apparatus that is primarily powered by the traveling web coat subject.

SUMMARY

These and other objects of the invention are accomplished by an independent roll frame assembly that is mounted on castered wheels for transverse rolling positionment in the feed path of the subject liner web between the supply reel unwind stand and the web preheater station of a double-facer machine assembly.

Included in the roll assembly is a rotatively driven gravure roll for coating liquid film pickup from an open tray reservoir. The gravure roll film is doctored by a steel blade as it emerges from the tray pond. That coating film remaining on the gravure roll surface is transferred by nip contact to a rubber covered transfer roll having a surface velocity about the same as the subject liner web which is trained over a small arcuate increment of the transfer roll surface. Such surface contact between the web and transfer roll uniformly transfers the coating film to the web surface. To smooth and finish the coating, the web is next trained over a rotatively driven, counter-rotating smoothing roll.

Power to drive the gravure and smoothing rolls is derived from an S-wrap of the subject liner web over and through the nip of a cooperative drive roll pair. A drive chain around sprockets respective to one roll of the driving pair, the gravure roll and the smoothing roll delivers drive power. Frictional contact with the chain driven gravure roll drives the coat transfer roll.

As an operational safety feature, web movement is continuously monitored. If interrupted, the drive roll nip is opened and the web lifted from contact with the transfer roll. Simultaneously, an auxiliary drive motor is started to maintain rotation of the gravure roll and prevent drying of the coating liquid on the gravure roll surface.

BRIEF DESCRIPTION OF THE DRAWING

Relative to the drawing wherein like reference characters designate like or similar elements of the invention.

DESCRIPTION OF THE PREFERRED EMBODIMENT

Figure 1:
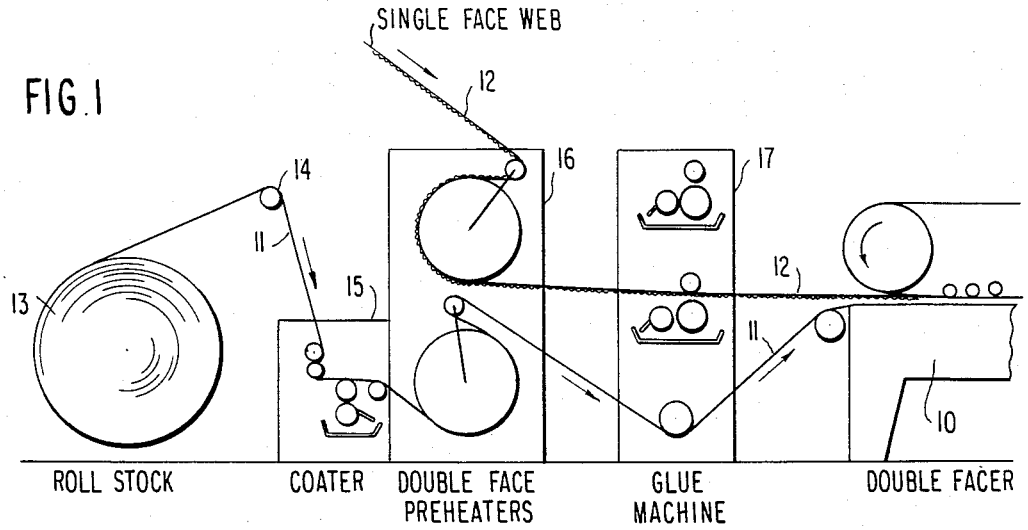
FIG. 1 is an elevational schematic of the material supply end of a double-facer corrugated board machine showing the relative operating position of the invention.

The intended operational environment of the invention is represented by FIG. 1 which shows the material supply end of a double facing apparatus 10 for applying the second facing web 11 to a previously laminated assembly 12 of a corrugated web with a first, single-facing web.

From an unwind stand, the second facing web 11 is drawn from a reel 13 and over a turning roll 14 into the coating station 15 of the present invention. Heated drums respective to the single-faced web 12 and the second facing web 11 comprise a preheating station 16 for thermal preparation of the webs prior to laminated assembly. A glue station 17 applies adhesive to the exposed flute tips of the in-running single-faced web 12.

Figure 2:
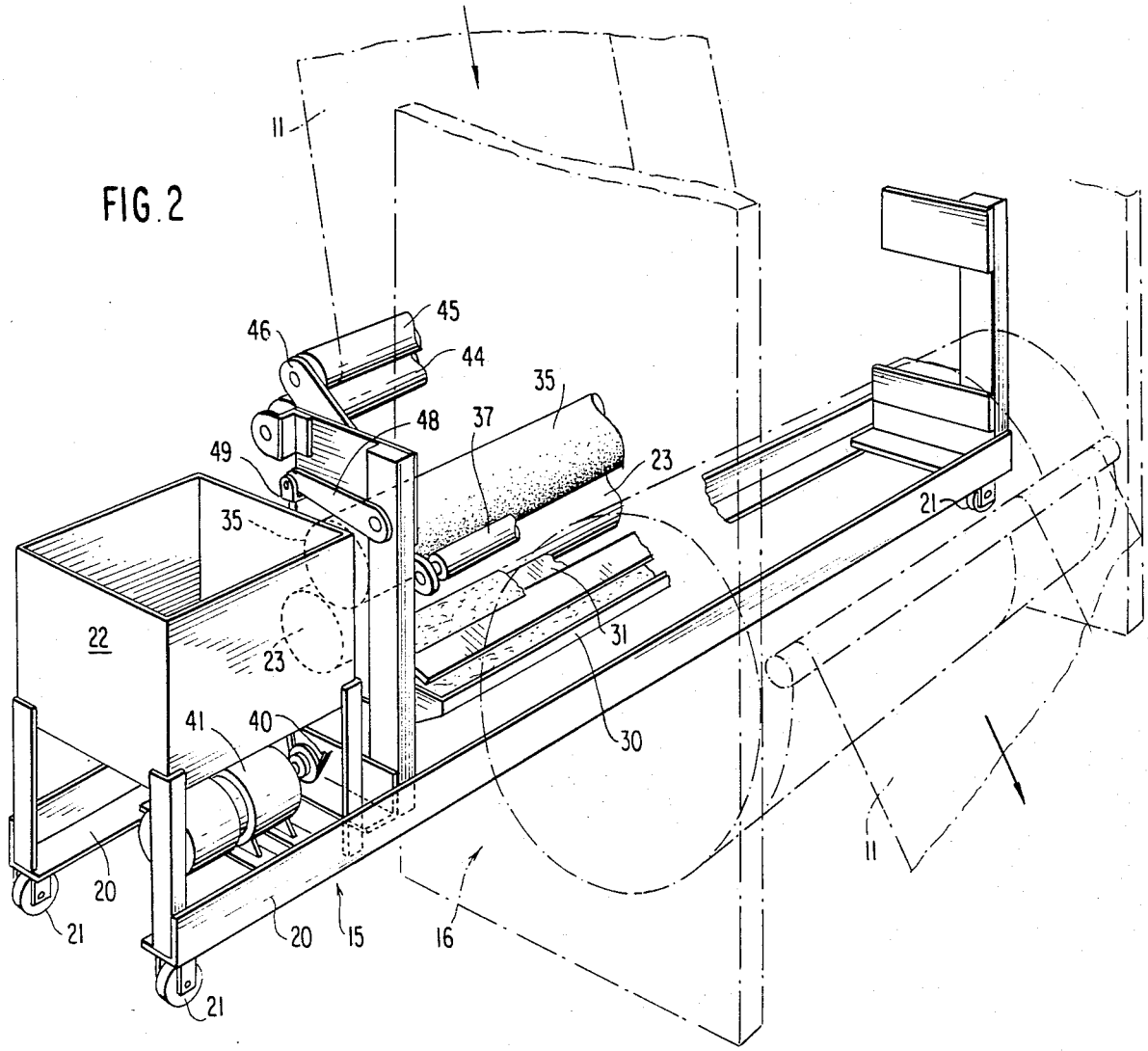
FIG. 2 is a phantom line pictorial of the present invention.
Figure 3:
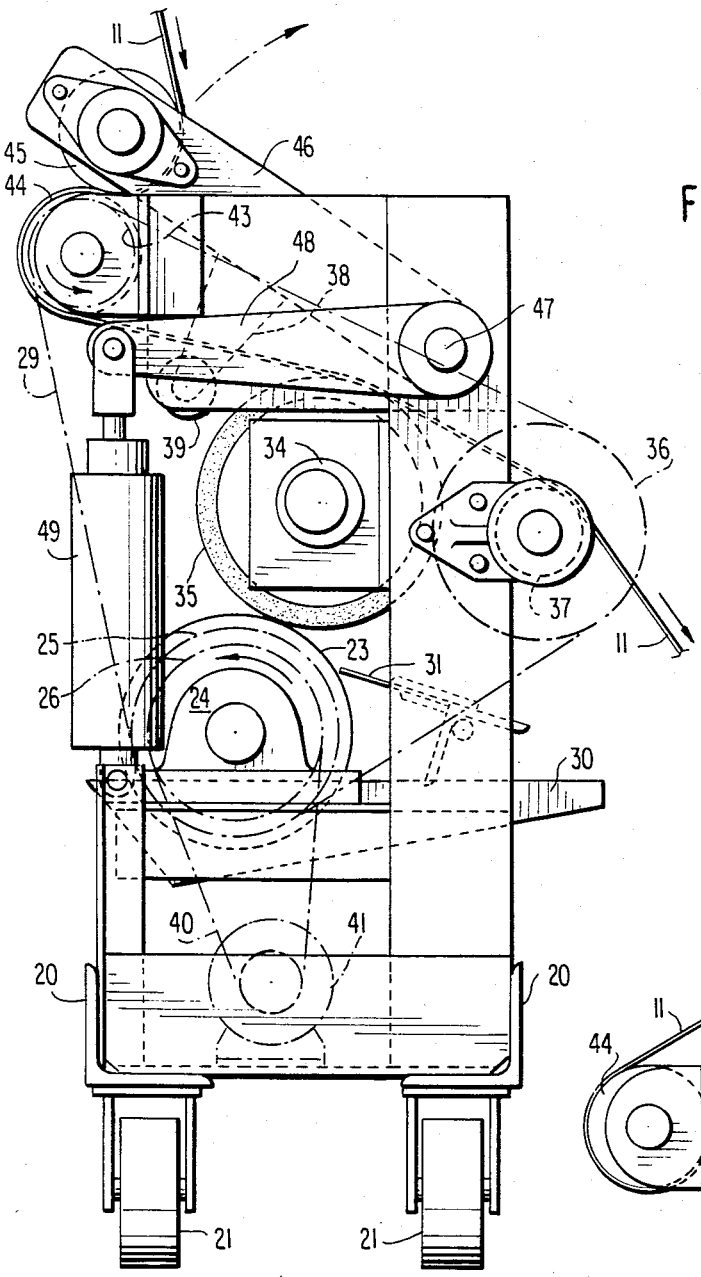
FIG. 3 is an end elevation of the present invention.

FIG. 2 illustrates the coating station 15 as including a rail frame 20 mounted on caster wheels 21. On the operator end of the frame 20 is mounted a coating liquid reservoir 22. The roll and drive arrangement of the coating station 15 is also shown by FIG. 3 to include a gravure surfaced roll 23 mounted for axle rotation within rigidly secured pillow block bearings 24. Nonrotatively secured to the drive end of the gravure roll axle are two co-axial chain sprockets 25 and 26 shown by FIG. 3 as broken line circles. Sprocket 25 carries the primary drive chain 29. Sprocket 26 carries the auxiliary drive chain 40 which also wraps the drive sprocket of the auxiliary drive motor 41.

Pan 30 is disposed under the gravure roll 23 along the full length thereof and carries a level controlled pond of coating liquid to emerse a chordal segment of the gravure roll 23. Replenishment coating liquid is drawn from the reservoir 22.

To level and regulate the thickness of coating film carried from the pond by the surface of gravure roll 23, a doctor blade assembly 31 is secured alongside the gravure roll for angular adjustment relative to the gravure roll surface.

Eccentric journals 34 secured to opposite ends of the machine frame carry respective axle ends of a rubber covered transfer roll 35. By angular adjustment of the eccentrics 34, the surface of transfer roll 35 is pressed against the surface of gravure roll 23 for nip transfer of the coating film and for frictional drive contact.

Drive chain 29 is also routed over a drive sprocket 36 respective to smoothing roll 37 over which the route of web 11 is directed following contact with the transfer roll 35. Note should be taken that the rotational direction of smoothing roll 37 is such as to provide oppositely directed surface contact respective to the coated side of web 11 and the surface of roll 37.

Sprocket 43 mounted on the axle end of the stationary drive roll 44 serves to transfer drive movement to the chain 29 and, hence, to all other driven rolls in the chain circuit. Cooperating with the stationary drive roll 44 is the nip drive roll 45 mounted on the distal ends of radius arms 46. These radius arms 46 are secured to crankshafts 47 which are rotatively mounted in frame journals. Also secured to crankshafts 47 on the opposite side of frame uprights are crank arms 48. Piston/cylinder rod fluid actuators 49 are secured between the machine frame and the distal ends of crank arms 48 to drive the crank arm 48, radius arm 46 and nip drive roll 45 assembly through an arc about the center of crankshaft 47.

Figure 4:
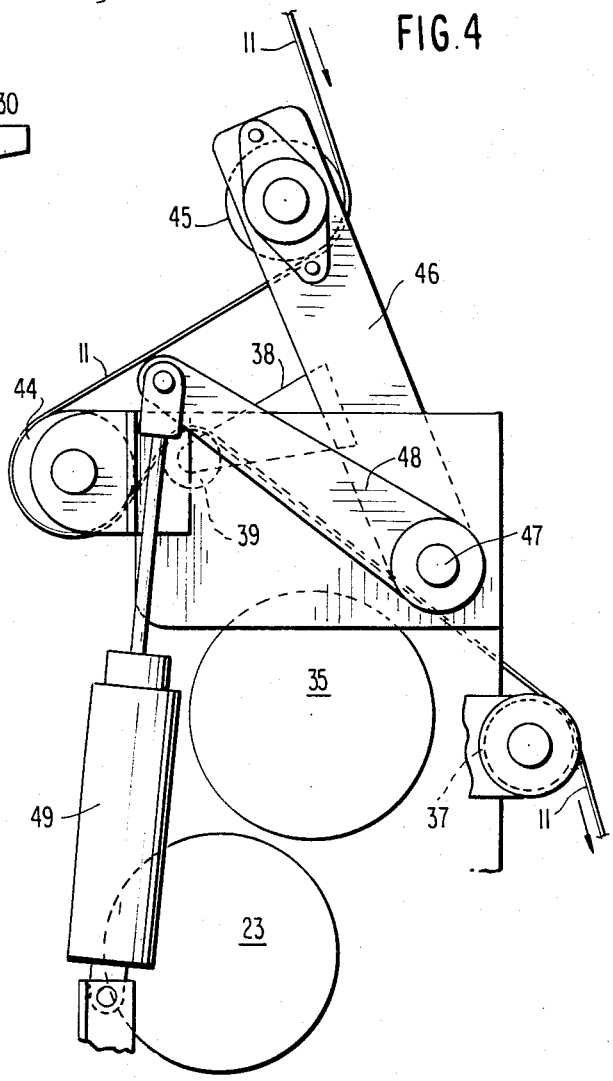
FIG. 4 is a detailed end elevation of the invention showing the S-roll drive nip in the opened position.

From FIG. 4 it will be seen that the threading route of web 11 is under nip roll 45 and over stationary drive roll 44. When closed, nip pressure between rolls 44 and 45 induced by contraction of the fluid actuator 49 extracts drive force from the web 11 which is transmitted to the chain 29 via drive roll sprocket 43. When the roll 44 and 45 nip is opened by expansion of fluid actuators 49, a smooth surface cylindrical bar 39 mounted at the distal ends of bracket arms 38 is rotated into position to lift the web 11 off the surface of transfer roll 35 as best illustrated by FIG. 4.

Automatic controls for the machine may include a tachometer or such rotational sensor and proportional signal transmitter responsive to the rotation of stationary drive roll 44. When the monitoring tachometer senses a stoppage of the drive roll 44 rotation to indicate a cessation of web 11 travel, guard circuitry actuated by the tachometer transmitter initiates a fluid transfer to the fluid actuator 49 which opens the nip between drive rolls 44 and 45. Opening of the drive roll nip is accomplished by rotation of the swing arms 46 which carry the dependent bar 39 for lifting the web 11 off the surface of continuously rotating transfer roll 35. When the swing arms 46 reach the arcuate position illustrated by FIG. 4 a position limit switch closes to start the auxiliary drive motor 41.

As with most gravure coating or printing machines, it is essential that the coating liquid not be allowed to dry or set on the gravure or transfer cylinders. Such is the objective served by the auxiliary motor 41 which keeps the coat application system operating throughout a temporary interruption in the web 11 travel.

Having fully disclosed our invention, those of ordinary skill in the art will recognize obvious alternatives and equivalents. As disclosed, the invention is a structurally independent machine for coating one face of a traveling web. Being structurally independent, it may be selectively and conveniently removed from the operating line of a more comprehensive converting machine such as the double-backer illustrated. When not in use, the present coating apparatus may be rolled on its wheeled undercarriage away from the double-backer operating environment. Except for the small auxiliary motor 41, all rotary drive power is derived from the web 11. As our invention, therefore,

We claim:

1. A web coating apparatus comprising manually mobile frame means for supporting a rotatively driven gravure roll in surface drive nip contact with a resiliently covered transfer roll for transfer of a doctored film thickness of liquid coating material to one side of a traveling web, a counter-rotatively driven smoothing roll in surface contact with the coated side of said traveling web, a pair of drive rolls pressed into mutual, rolling nip contact for receiving said web therebetween for rotationally powering said drive rolls prior to receipt of said coating material, rotary drive elements secured to one of said drive rolls and to said gravure and smoothing rolls, respectively, and, rotational drive linkage means connecting said drive elements for driving said gravure and smoothing rolls with the rotational power delivered by said traveling web to said one drive roll.

2. A coating apparatus as described by claim 1 comprising lifting bar means movably disposed in the proximity of the path of said traveling web between said drive roll nip and said transfer roll for selectively moving said web out of contact with said transfer roll.

3. A coating apparatus as described by claim 2 comprising movable mounting means for the other roll of said drive roll pair and for carrying said lifting bar whereby selective removal of said other roll from nip contact with the one roll of said pair simultaneously moves said web out of contact with said transfer roll.

4. A coating apparatus as described by claim 1 comprising movable mounting means for the other of said drive roll pair and for selectively removing said other roll from nip contact with the one roll of said pair.

5. A coating apparatus as described by claim 3 comprising control means for sensing the interruption of said web travel and responsively operating said movable mounting means to open said drive roll nip.

6. A coating apparatus as described by claim 1 comprising auxiliary drive means engaging said drive linkage means for selectively driving said gravure and smoothing rolls drive elements.

* * * * *